US006508099B1

(12) United States Patent
Baulier et al.

(10) Patent No.: US 6,508,099 B1
(45) **Date of Patent: *Jan. 21, 2003**

(54) HEMMING MACHINE

(75) Inventors: Dominique Baulier, Windsor (CA); Darius Gheorghita, Belle River (CA)

(73) Assignee: Valiant Corporation (CA)

( * ) Notice: Subject to any disclaimer, the term of this patent is extended or adjusted under 35 U.S.C. 154(b) by 26 days.

This patent is subject to a terminal disclaimer.

(21) Appl. No.: 09/702,650

(22) Filed: Oct. 31, 2000

Related U.S. Application Data

(63) Continuation-in-part of application No. 09/679,677, filed on Oct. 5, 2000.

(51) Int. Cl.[7] ..... B21D 7/06

(52) U.S. Cl. ..... 72/418; 72/323; 72/384; 72/453.01; 72/453.06; 100/269.02; 100/269.03; 100/269.04

(58) Field of Search ..... 72/312, 323, 381, 72/384, 418, 453.01, 453.02, 453.06, 453.07; 100/269.02, 269.03, 269.04, 269.06, 269.08, 269.09

(56) References Cited

U.S. PATENT DOCUMENTS

| | | | | |
|---|---|---|---|---|
| 3,376,808 A | * | 4/1968 | Beckett et al. | 100/53 |
| 5,038,598 A | * | 8/1991 | Pitzer | 72/453.02 |
| 5,408,858 A | * | 4/1995 | Fukuda | 72/17.2 |
| 5,454,261 A | * | 10/1995 | Campian | 72/323 |
| 5,740,691 A | | 4/1998 | Kavarovic et al. | 72/323 |
| 6,029,493 A | | 2/2000 | Maier et al. | 72/312 |
| 6,098,440 A | | 8/2000 | Gorgen | 72/312 |

FOREIGN PATENT DOCUMENTS

EP 0 911 093 A1 4/1999

* cited by examiner

*Primary Examiner*—Ed Tolan
(74) *Attorney, Agent, or Firm*—Gifford, Krass, Groh, Sprinkle, Anderson & Citkowski, P.C.

(57) ABSTRACT

A hemming machine is disclosed having a base, a nest adapted to support a part to be hemmed, a nest carrier which supports the nest and in which both the nest and nest carrier are vertically movably mounted to the base. At least one hemming die is laterally slidably mounted to the base and movable between an extended position in which the die overlies a portion of the nest, and a retracted position in which the die is spaced laterally outwardly from the nest. A lock unit selectively locks the nest carrier against vertical movement relative to the base in at least one, and preferably two positions, so that, with the nest carrier locked against movement relative to the base, inflation of a hydraulic bladder sandwiched between the nest and nest carrier displaces the nest vertically upwardly from the carrier so that the part carried by the nest is compressed against the hemming dies and performs the hemming operation. Preferably, a single drive shaft not only displaces the nest and nest carrier, but also powers the hydraulic circuit to inflate the bladder and thus upwardly displace the nest relative to the nest carrier with an amplified force required to achieve the final flattening of the hem.

13 Claims, 8 Drawing Sheets

HEMMING MACHINE

CROSS REFERENCE TO RELATED APPLICATIONS

This application is a continuation-in-part of patent application Ser. No. 09/679,677 filed Oct. 5, 2000, entitled "Hemming Machine."

BACKGROUND OF THE INVENTION

I. Field of the Invention

The present invention relates generally to sheet metal hemming machines.

II. Description of Related Art

There are many previously known hemming machines. Many industries, such as the automotive industry, utilize sheet metal hemming machines to secure two metal parts together. These sheet metal hemming machines typically comprise a base having a nest vertically slidably mounted relative to the base. The nest, in turn, supports the part to be hemmed.

At least one, and typically three to five hemming die sets are laterally slidably mounted to the base and movable between an extended position and a retracted position. In the extended position, the die overlaps the nest so that vertical displacement of the nest toward the hemming die causes the part to be hemmed to be compressed upon the die thus forming the hem. Typically, a prehem is first formed by a prehem die to bend the sheet metal at an angle of approximately 45° while a final hem die retrorsely flattens the sheet metal hem together.

In order to form the hem, the part to be hemmed is first positioned on the nest and, with the hemming dies retracted, the nest is moved to a position just below the prehem die and clearing the part flange to be hemmed. The prehem die set is then moved to an extended position after which the nest is displaced vertically upwardly against the prehem die and retracted after having reached the nominal hemming pressure. The hemming dies are then moved to a retracted position and the nest is moved to a position just below the final hem die. The final hem die is then moved to an extended position and the nest is vertically displaced against the final hem die to complete the hem and also retracted after having reached the final hem pressure. The dies are then moved to their retracted position and the finished part is removed from the nest.

These previously known hemming machines have all suffered from a number of disadvantages. One disadvantage is that the previously known hemming machines have required the use of multiple hydraulic actuators to vertically displace the nest due to the massive weight of the nest. Such actuating means are expensive, hard to maintain and polluting.

Derivated from the previously already known machines, a first generation of electric hemmer has been developed by simply replacing the hydraulic cylinders by one or more linear ball screws powered by electronically synchronized drives.

But to face the double constraint of high production rate and high hemming pressure force, these drive configurations are generally oversized to be able to move quickly for a prehem to a final hem position in high speed, and then to deliver a high torque in static. Such oversizing (x4; x6) is not only expensive, but presents a real risk for the tooling in case of jamming or other incidental event, by introducing a tremendous reverse inertia to the system.

SUMMARY OF THE PRESENT INVENTION

The present invention provides a hemming machine which overcomes all of the above-mentioned disadvantages of the previously known devices.

In brief, the hemming machine of the present invention comprises a base which is fixed to a ground support surface. Both a nest and nest carrier are vertically slidably mounted to the base with the nest carrier positioned beneath the nest. In the conventional fashion, the nest is adapted to support the part to be hemmed.

Similarly, in the conventional fashion, at least one, and more typically three to five sets of dies, are laterally slidably mounted to the base between an extended and a retracted position. In their extended position, the dies overlie the nest and thus the part to be hemmed. Conversely, in their retracted position, the dies are laterally spaced from the nest to permit free vertical movement of the nest past the dies as well as the part loading/unloading. One die set typically performs the prehem while the other die forms the final hem.

The nest carrier and nest are vertically movably mounted not only relative to the base, but also relative to each other. In order to displace the nest relative to the nest carrier, at least one hydraulic driven bladder is sandwiched in between the nest and the nest carrier while a lock unit selectively locks the nest carrier against downward movement. Thus, with the nest carrier locked against vertical movement, inflation of the driven bladder vertically displaces the nest upwardly relative to the nest carrier.

In order to selectively inflate and deflate the driven bladder, at least one drive bladder is sandwiched in between a piston and the nest. This drive bladder is fluidly connected to the driven bladders by fluid conduits. Thus, with the nest carrier locked against downward vertical movement, movement of the piston toward the nest compresses the drive bladders thus pumping hydraulic fluid contained within the drive bladders from the drive bladders and to the driven bladders. This in turn vertically displaces the nest upwardly relative to the nest carrier so that, with the hemming dies in their extended position, the part to be hemmed is compressed against the hemming dies in the desired fashion.

In the preferred embodiment of the invention, a plurality of pressurized pneumatic spring (or air) bladders are sandwiched between the base and nest carrier and urge the nest and nest carrier upwardly. Additionally, a single rotary shaft is rotatably mounted to the base and extends through an opening in the nest carrier and threadably engages the piston. The piston in turn abuts against an upper surface of the nest carrier thus holding the nest carrier against upward movement due to the force developed by the pneumatic spring bladders.

With the lock unit in its retracted position so that both the nest carrier and nest can move vertically relative to the base, rotation of the shaft vertically moves the piston upwardly so that the inflation of the air spring bladders likewise moves both the nest and nest carrier upwardly in unison with each other in order to position the upper surface of the nest beneath either the prehem or final die. When the nest is so positioned, one or more lock units engage the nest carrier to preclude downward movement of the nest carrier.

Thereafter, continued rotation of the shaft in the same direction continues to move the nest together with the part to be hemmed upwardly until the part engages the hemming die. When this occurs, the upward movement of the piston encounters an increasing downward force due to the compression of the part against the hemming die. When this occurs, the continued upward movement of the piston causes the piston to separate from the nest carrier and, in doing so, compress the drive bladders. This in turn inflates the driven bladders with amplified force thus displacing the nest upwardly from the nest carrier and performing either the hem or prehem operation.

The surface ratio between the drive and driven bladders is such that the force developed by the drive bladder is amplified by a factor of four to eight.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
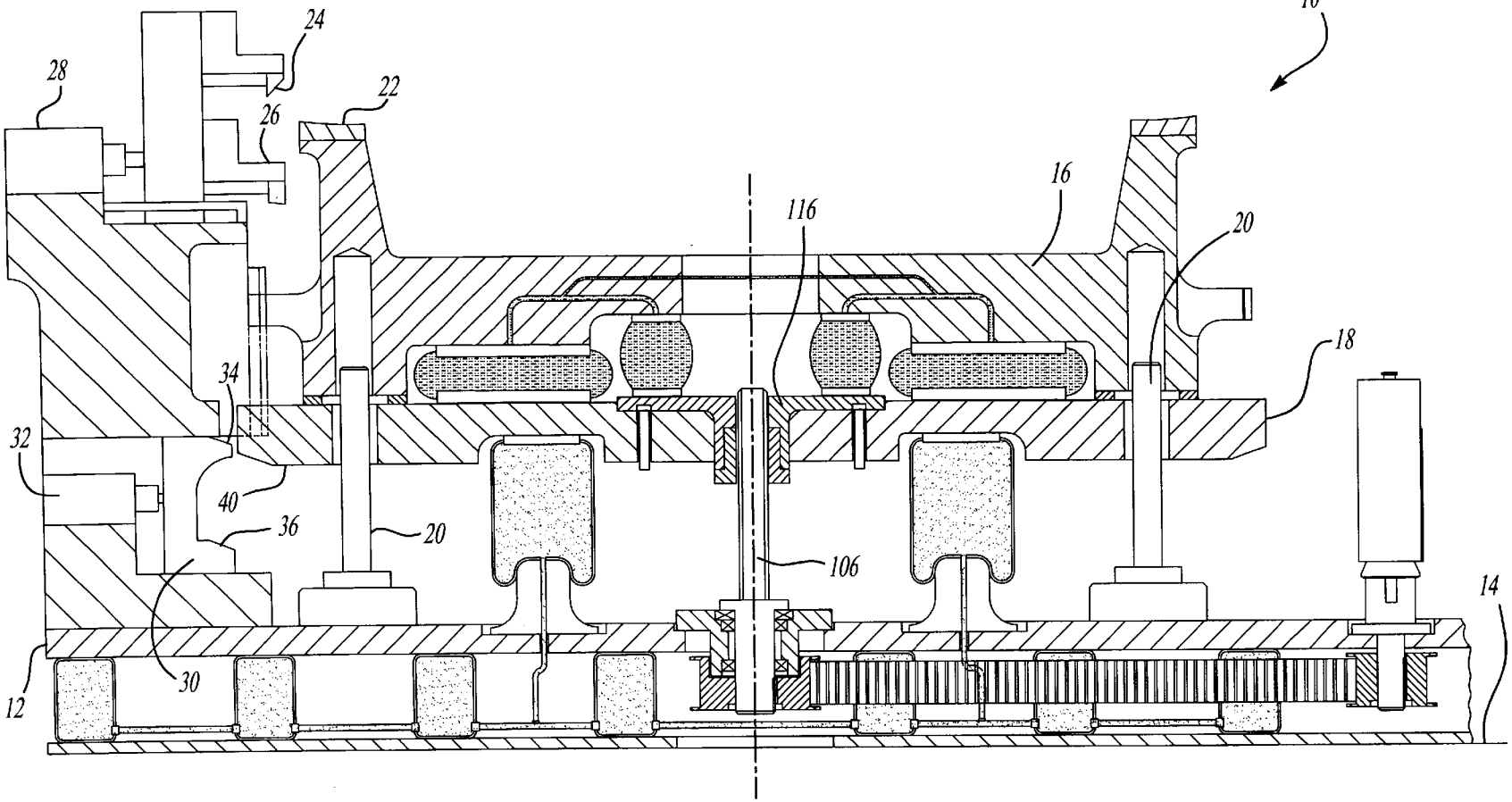
FIG. 1 is a sectional view illustrating the preferred embodiment of the hemming machine of the present invention being moved to a prehem operation position, ready to engage the upper die set, and pre-engage locks.

With reference first to FIG. 1, a preferred embodiment of the hemming machine 10 of the present invention is there shown and comprises a stationary base 12 supported by a ground surface 14. A nest carrier 18 is vertically slidably mounted to the base 12 by vertical slides 20 and a nest 16 is laterally guided by slides 21 against the base frame, both of which may be of any conventional construction. In the initial stage of the hemming operation illustrated in FIG. 1, i.e. part loading and unloading, the nest 16 is positioned above and supported by the nest carrier 18 in a fashion which will be subsequently described in greater detail. Furthermore, the part to be hemmed is supported by the upper surface 22 of the nest 16.

Figure 2:
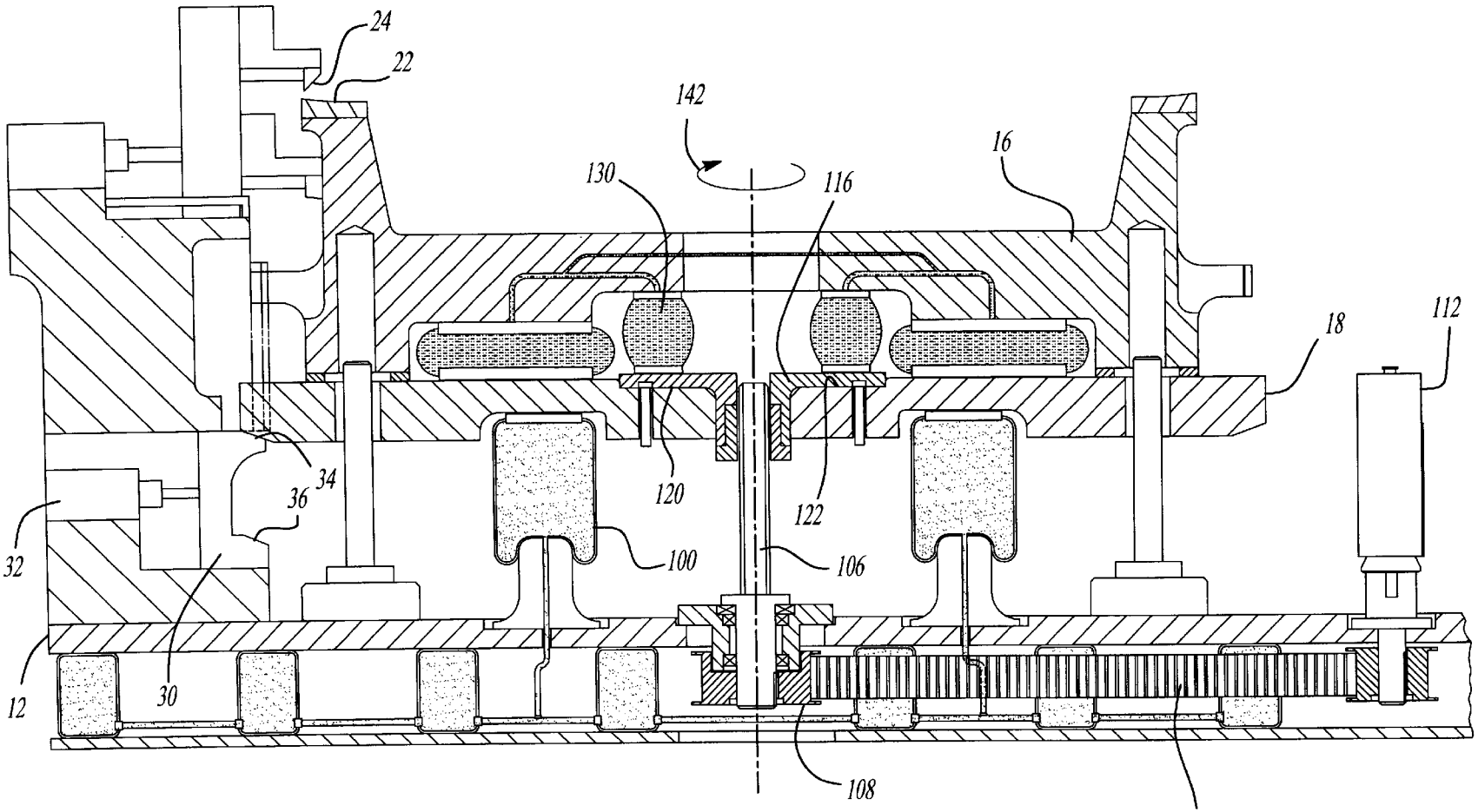
FIG. 2 is a view similar to FIG. 1, but illustrating the hemming machine just after the prebending at 45°, and prior to developing the prehem force to sharpen the 45° edge.

Still referring to FIG. 1, at least one, and more typically three to five sets of hemming dies 24 and 26 are laterally slidably mounted to the base 12 between an extended position, illustrated in FIG. 2, and a retracted position, illustrated in FIG. 1. Any conventional means, such as an electric or pneumatic cylinder 28, is utilized to move the die sets 24 and 26 between their extended and retracted position.

With the die sets 24 and 26 in their extended position as illustrated in FIG. 2, the dies 24 and 26 overlie the upper surface 22 of the nest 16 and thus overlie the part to be hemmed. Conversely, with the dies 24 and 26 in their retracted position as shown in FIG. 1, the nest may be vertically displaced without interference with either the dies 24 or 26. Typically, one die 24 is utilized to produce the prehem typically at a 45° angle on the part, while the other die 26 performs the final hem.

Still referring to FIGS. 1 and 2, a lock unit(s) 30 is laterally slidably mounted to the base 12 and movable between an extended position, illustrated in FIG. 2, and a retracted position, illustrated in FIG. 1. Any conventional means, such as a pneumatic or electric cylinder 32, may be used to selectively move the lock unit(s) 30 between its extended and retracted position.

The lock unit includes an upper abutment surface 34 as well as a lower abutment surface 36. These abutment surfaces 34 and 36, furthermore, are spaced apart from each other by substantially the same distance as the vertical spacing between the dies 24 and 26. Thus, with the nest carrier in the upper position illustrated in FIG. 2 such that the nest surface 22 is positioned 2" to 3" below the prehem die 24, and after a preliminary stroke of the next carrier (1⅞ to 2⅞), the lock unit is finally engaged to its extended position (FIG. 2), a lower surface 40 of the nest carrier abuts against the upper abutment surface 34 of the lock unit 30. Consequently, in this position, the lock unit 30 prevents downward movement of the nest carrier 18 relative to the base.

Figure 5:
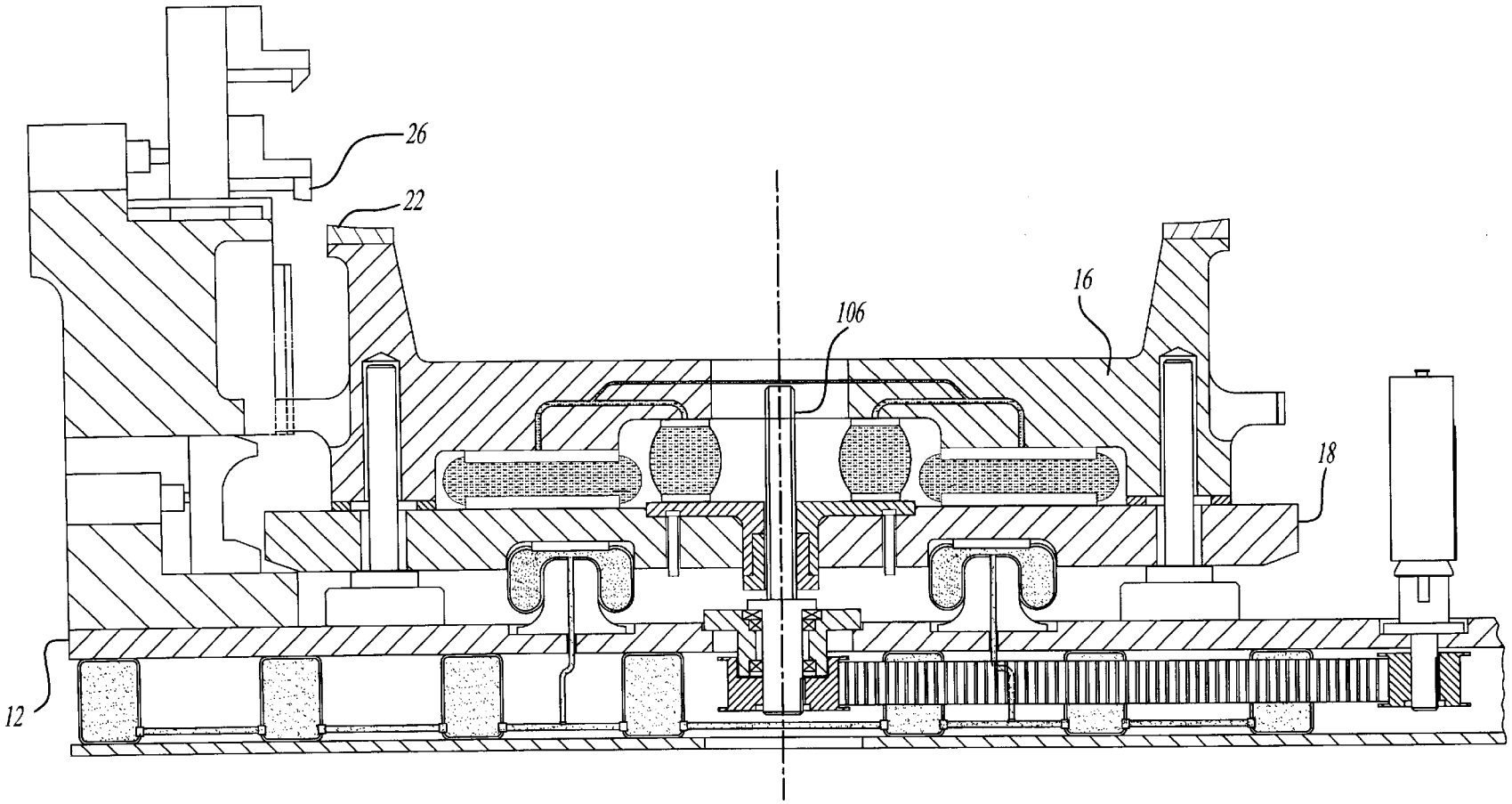
FIG. 5 is a view similar to FIG. 4, but illustrating the hemming machine moved to a position in preparation for the final hemming operation.

Similarly, as shown in FIG. 5, with the nest carrier 18 in its lower position such that the nest surface 22 is positioned 2" to 3" below the final hem die 26, and after a preliminary stroke of the nest (1⅞" to 2⅞"), the lock unit 30 will reach its extended position causing the lower surface 40 of the nest carrier 18 to abut against the lower abutment surface 36 of the lock unit 30. The lock unit 30 thus locks the nest carrier 18 against further downward movement relative to the base 12.

As best shown in FIG. 1, both abutment surfaces 34 and 36 on the lock unit 30 are tapered downwardly and correspond with a like upwardly tapered surface 40 on the nest carrier 18. The cooperating tapered surfaces 34 and 40 or surfaces 36 and 40 thus allow the cooperating surfaces to slide against each other as the nest carrier 18 is moved to either its upper position (FIG. 2) or its lower position (FIG. 6).

Figure 6:
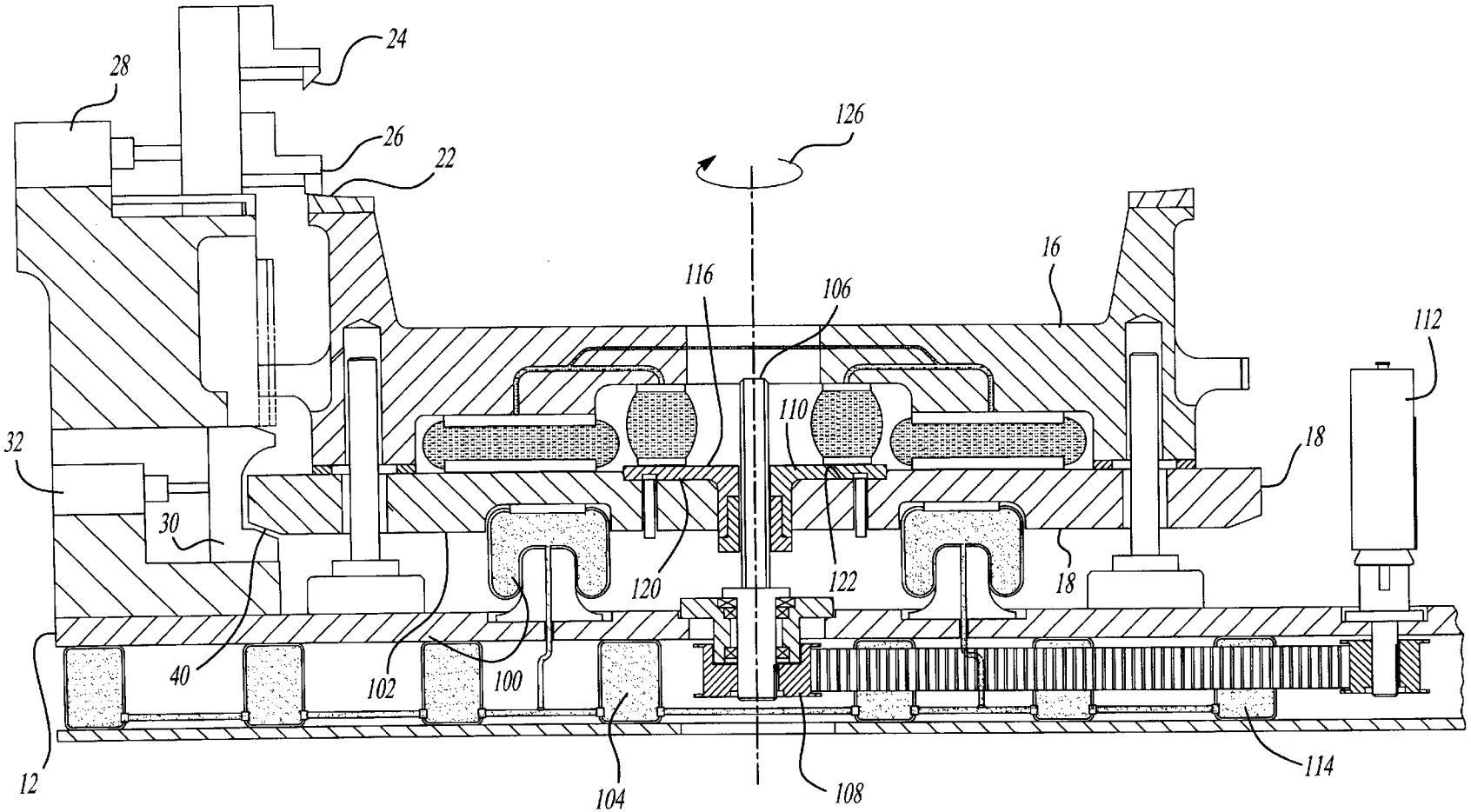
FIG. 6 is a view similar to FIG. 5, but illustrating the hemming machine just prior to applying the final hemming force to fully flatten the hem flange at the final hem operation.

With reference now to FIGS. 2 and 6, in order to vertically displace the nest 16 together with the nest carrier 18 from its lower position (FIG. 6) to its upper position (FIG. 2), a plurality of pressurized pneumatic spring bladders 100 are sandwiched in between the base and a lower surface 102 of the nest carrier 18. The spring bladders 100, furthermore, are pressurized by a pneumatic circuit with a pressure sufficient to move and accelerate both the nest carrier 18 and nest 16 from their lower position (FIG. 6) and to their upper position (FIG. 2) unless restrained. One or more air reservoirs or surge tanks 104 form a part of the pneumatic circuit.

Still referring to FIGS. 2 and 6, in order to provide controlled vertical movement of both the nest carrier 18 and nest 16 between their upper position (FIG. 2) and lower position (FIG. 6), an externally threaded shaft 106 is rotatably mounted by a bearing assembly 108 to the base 12 so that the shaft 106 extends through an opening 110 formed in the nest carrier 18. Any conventional means, such as an electric motor or hydraulic motor 112, is utilized to rotatably drive the shaft 106 via a timing belt mechanism 114.

The shaft 106 threadably engages an internally threaded piston 116 which is positioned between the nest 16 and nest carrier 18. A lower surface 120 of the piston 116 abuts against an upper surface 122 of the nest carrier 18 in order to limit the upward movement of the nest carrier 18 and thus the upward movement of the nest 16.

For example, assuming that the nest carrier 18 is in the position illustrated in FIG. 6 and also assuming that the dies 24 and 26 are in their retracted position, rotation of the shaft 106 in the direction of arrow 126 causes the piston 116 to move upwardly. Simultaneously, the spring bladders 100, due to their pressurization, upwardly displace both the nest carrier 18 and nest 16 in unison with the piston 116. The expansion of the spring bladders 100 together with the rotation of the shaft 106 are utilized to move the nest 16 and nest carrier 18 between the position shown in FIG. 6, i.e. just prior to a final hem operation, and the position shown in FIG. 2, i.e. just prior to a prehem operation. With the nest carrier 18 in either the position shown in FIG. 2 or FIG. 6, the lock unit 30 is moved to its extended position thus locking the nest carrier 18 against downward movement.

Figure 3:
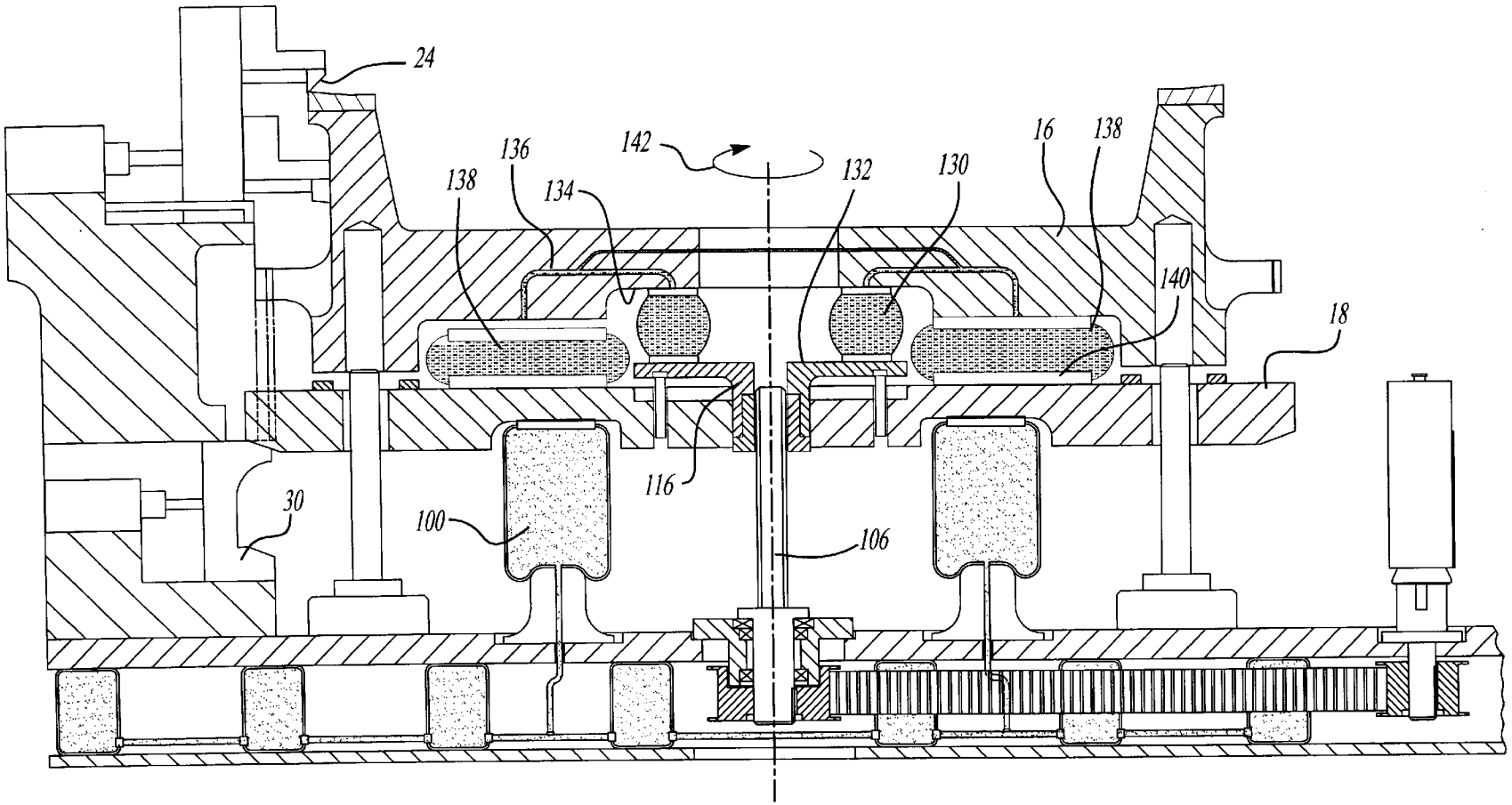
FIG. 3 is a view similar to FIG. 2, but illustrating the end of the prehemming operation.

With reference now to FIGS. 2 and 3, in order to move the nest 16 from a position just prior to the prehem position (FIG. 2) and to the final prehem position (FIG. 3), at least one, and preferably several drive bladders 130 are sandwiched in between an upper surface 132 of the piston 116 and a lower surface 134 on the nest 16. These drive bladders 130, furthermore, are fluidly connected by a conventional fluid circuit 136 to driven bladders 138 which are sandwiched in between the lower surface 134 of the nest 16 and an upper surface 140 of the nest carrier 18. Consequently, deflation of the drive bladders 130 causes a resultant inflation of the driven bladders 138 thus separating the nest 16 from the nest carrier 18. Preferably, the drive bladders 130 and driven bladders 138 are dimensioned to provide an amplification of four to eight.

With the hemming machine 10 positioned as shown in FIG. 2, the nest 16 is positioned in preparation for a final prehem operation. At this time, the nest 16 is in abutment with the nest carrier 18 while the lock unit 30 prevents downward movement of the nest carrier 18.

Figure 7:
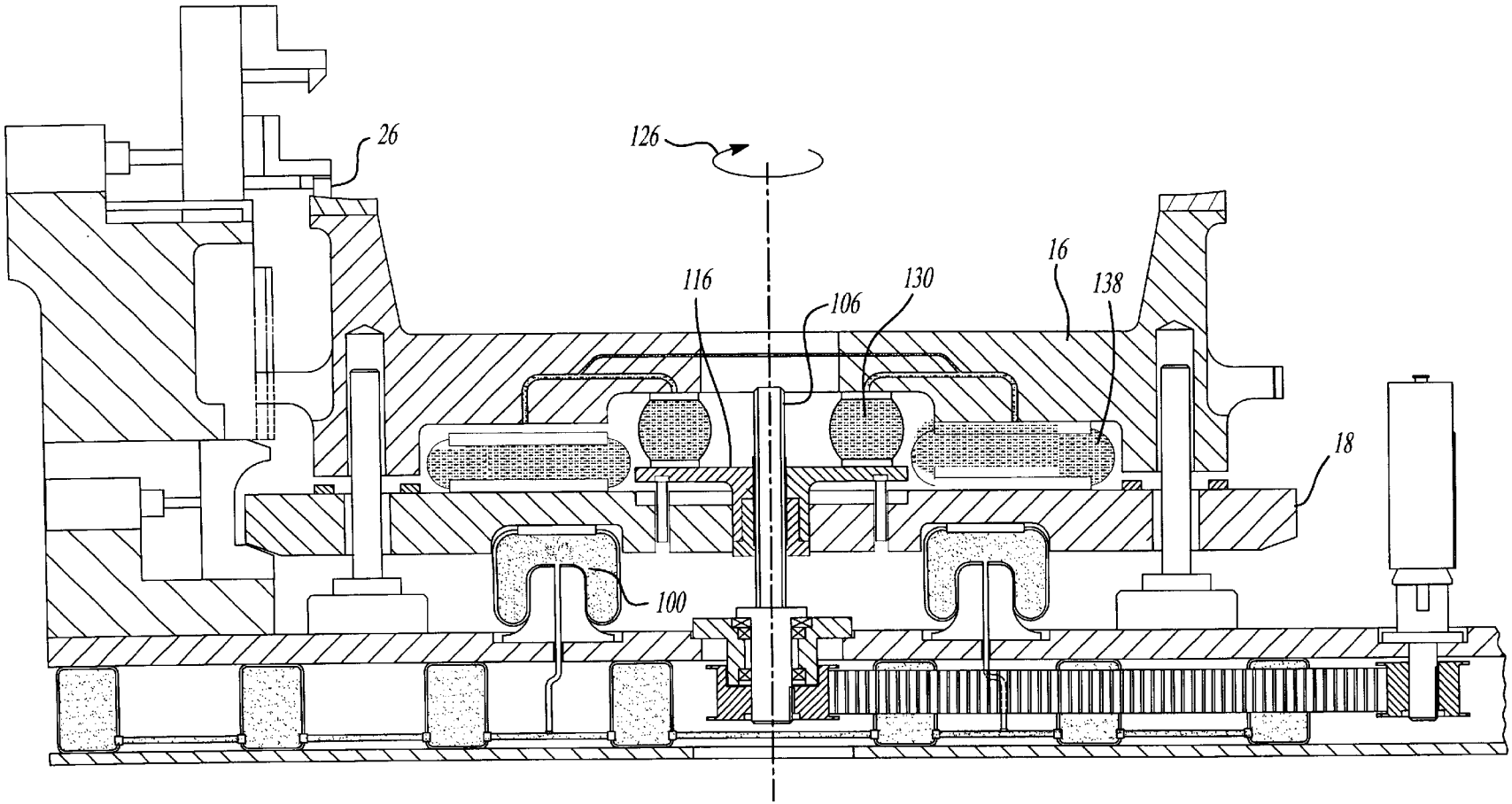
FIG. 7 is a view similar to FIG. 6, but illustrating a final hem operation.

Continued rotation of the shaft 106 in the direction of arrow 142 causes the nest 16 to move upwardly so that the part to be hemmed engages the prehem die 24. When this occurs, the increased resistance caused by the compression of the part against the prehem die 24 overcomes the pressure in the air spring bladders 100 and causes the piston 116 to separate from the nest carrier 18 as shown in FIG. 3 thus compressing the drive bladders 130 and inflating the driven bladders 138. This in turn causes the nest 16 to separate from the nest carrier 18 from the position shown in FIG. 2 and to the position shown in FIG. 3 thus performing the prehemming operation. FIGS. 6 and 7 illustrate the identical sequence of operation for the final hem operation.

A primary advantage of Applicant's invention is that the shaft 106 together with the air springs are utilized to move the nest 16 from its lower position as well as perform both the prehem and hem operations without reversing the direction of rotation of the shaft 106. Reversal of the direction of rotation of the shaft 106 is only necessary to move the nest 16 and nest carrier 18 from their upper position following the prehemming operation and to the lower position just prior to the final hem operation. Consequently, cycle time is minimized.

The operation of the hemming machine will now be described. In FIG. 1, the nest 16 is illustrated in a part load/unload position in which the dies 24 and 26 are in their retracted position and the lock unit 30 is likewise in a retracted position. The nest support surface 22 is positioned in between the dies 24 and 26.

As best shown in FIG. 2, rotation of the shaft 106 in the direction of arrow 142 moves the piston 116 upwardly thus allowing expansion of the air spring bladders 100. The expansion of the air spring bladders 100 moves the nest carrier 18 as well as the nest 16 supported by the nest carrier 18 to the position shown in FIG. 2, performing by there the prebending of the flange at 45°, and in which the nest surface 122 is in a position thus prior to the final prehemming operation. At this time, the dies 24 and 26 are moved to their extended position while, likewise, the lock unit 30 is moved to its extended position thus preventing downward movement of the nest carrier 18 relative to the base 12.

With reference now to FIG. 3, continued rotation of the shaft 106 in the same direction as shown by arrow 142 causes the part to be hemmed to compress against the prehem die 24. When this occurs, the increased resistance caused by the compression of the part against the hemming die 24 overcomes the pressure of the air spring bladders 100. Consequently, continued rotation of the shaft 106 causes the piston 132 to lift upwardly from the nest carrier 18 and compress the drive bladders 130 against the nest 16. This in turn inflates the driven bladders 138 with an amplification factor thus causing the nest 16 to separate upwardly from the nest carrier and compress the part against the prehem die 24. Furthermore, during the prehem operation, the lock unit 30 is in its extended position thus preventing the nest carrier 18 from shifting downwardly upon the expansion of the driven bladders 138.

Figure 4:
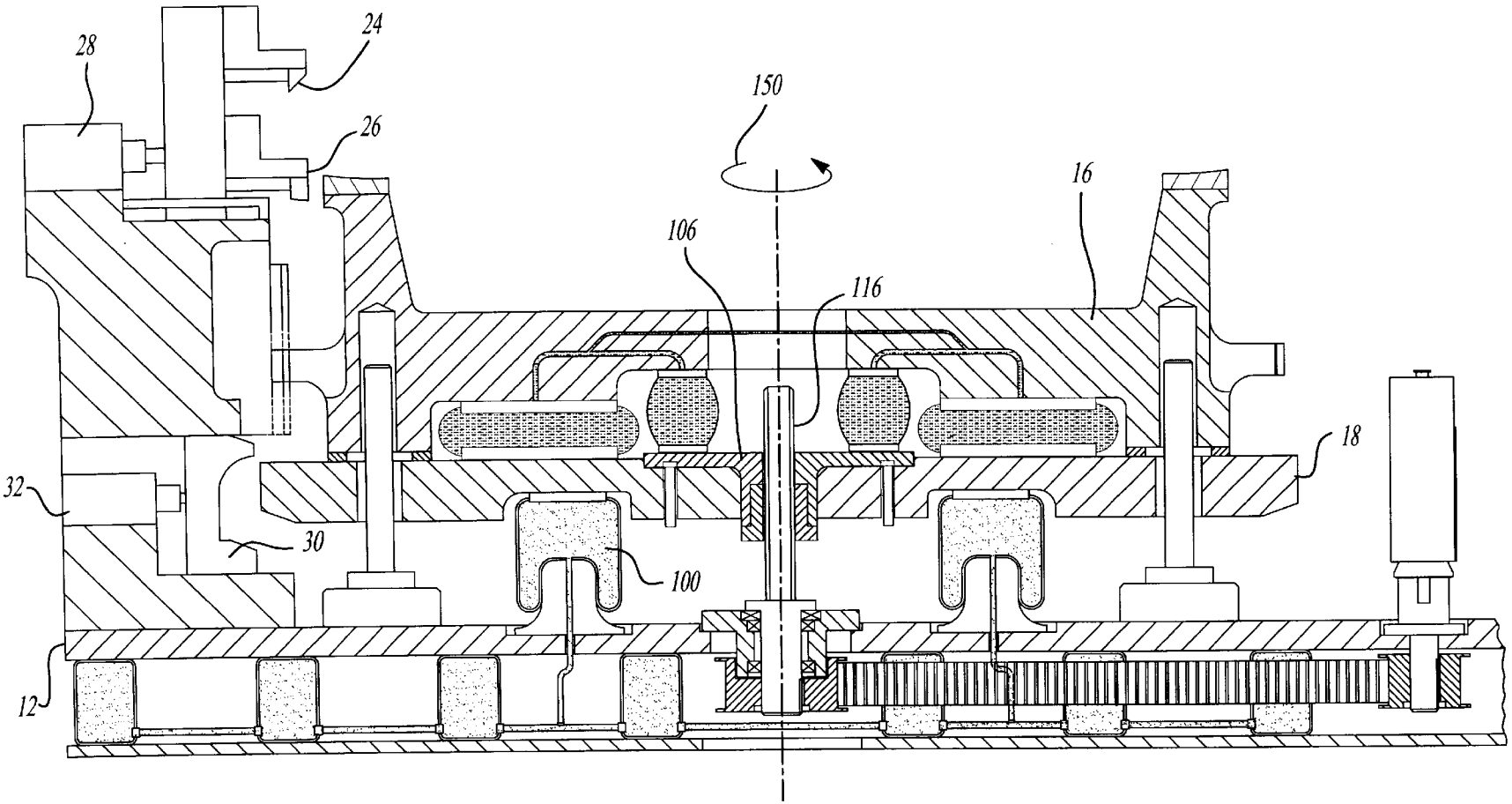
FIG. 4 is a view similar to FIG. 1, but illustrating the hemming machine being moved to a position ready to engage the final hemming die set and pre-engage lock units for a final hem operation.

Following the prehem operation, the hemming dies 24 and 26 are moved to their retracted position by the cylinder 28 as shown in FIG. 4 and, likewise, the lock unit 30 is moved to its retracted position by the cylinder 32. The direction of rotation of the shaft 106 is reversed as illustrated by arrow 150 thus moving the piston 116 downwardly. The downward movement of the piston 116 likewise moves the nest carrier 18 together with the nest 16 downwardly against the force of the spring bladders 100 until the nest 16 and nest carrier 18 reach the position illustrated in FIG. 5. At this time, the nest surface 22 is positioned 2" to 3" below the final hem die 26. At this time, the cylinder 28 moves the hemming dies 24 and 26 to their extended position and, likewise, the cylinder 32 attends to move the lock unit 30 to its extended position.

With reference now to FIG. 6, the rotation of the shaft 116 is reversed as shown by arrow 126 thus moving the piston 116 upwardly. Simultaneously, the spring bladders 100 move both the nest carrier 18 and nest 16 upwardly to the position shown in FIG. 6 in which the nest surface 22 is positioned just below its final hem position. At this time, under the action of cylinder 32, the lock unit will fully engage, thus precluding downward movement of the nest carrier 18.

With reference now to FIG. 7, the continued rotation of the shaft 106 in the direction of arrow 126 causes the nest 16 to move upwardly so that the part is compressed against the final hem die 26. The force exerted between the final hem die 26 and the part, together with the weight of the nest 16, nest carrier 18, and their associated components, overcomes the pressure of the air spring bladders 100. When this occurs, the piston 116 again separates upwardly from the nest carrier 18 thus compressing the drive bladders 130 and inflating the driven bladders 138. As with the prehem operation, the inflation of the driven bladders 138 causes the nest 16 to separate upwardly from the nest carrier 18 thus moving the nest from the position shown in FIG. 6 to the final hem position shown in FIG. 7.

Figure 8:
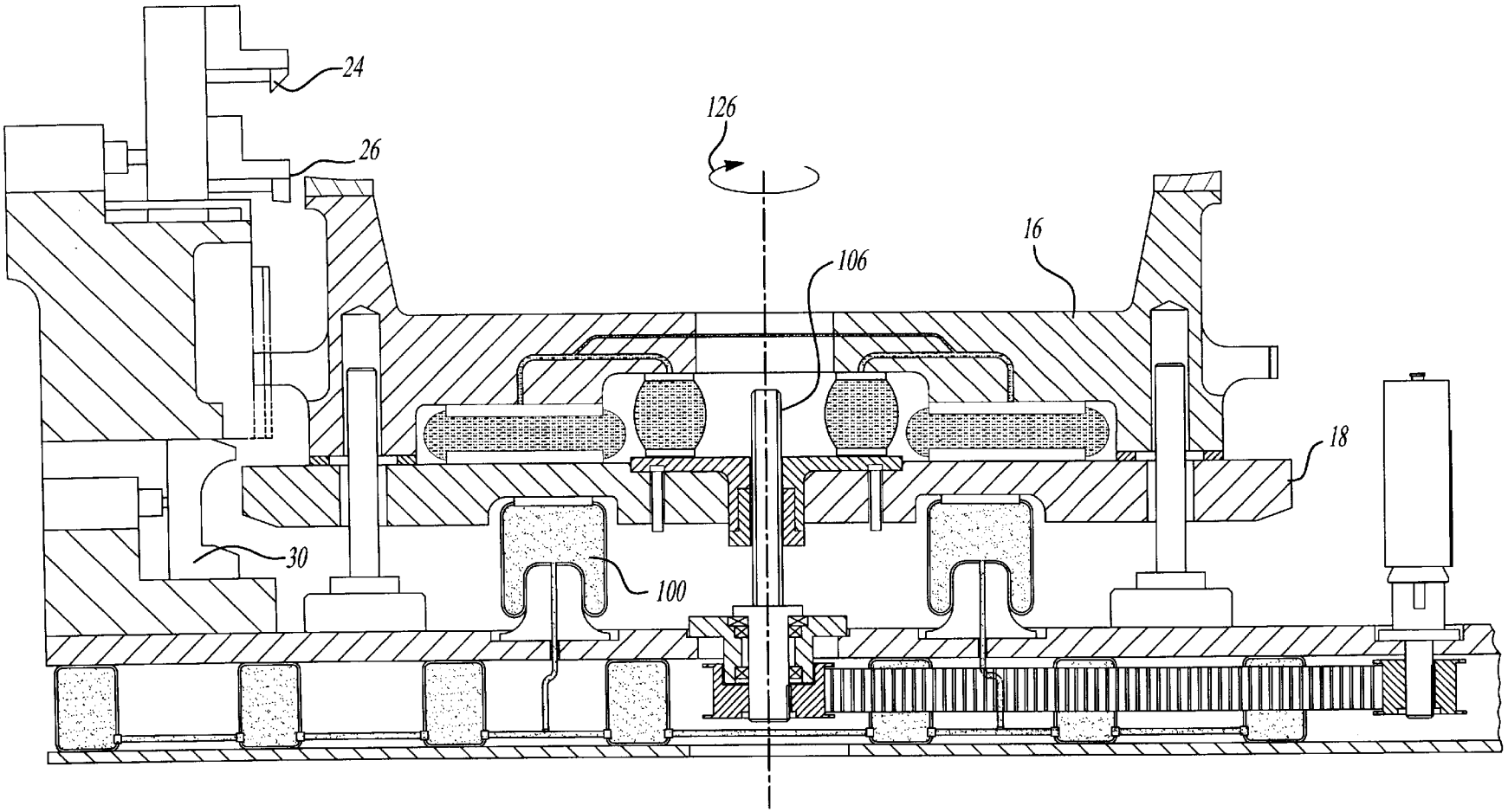
FIG. 8 is a view similar to FIG. 2, but illustrating the hemming machine following completion of the final hemming operation and on its way to reach the part unload/reload position.

With reference now to FIG. 8, following the final hem operation, the hemming dies 24 and 26 are moved to their retracted position thus allowing vertical displacement of the nest 16 without interference from the hemming dies 24 and 26. Likewise, the lock unit 30 is moved to its retracted position thus allowing the spring bladders 100 to urge the nest carrier 18 and nest 16 upwardly. Thus, continued rotation of the shaft 106 in the same direction as during the final hem operation as illustrated by arrow 126 moves the nest 16 to the load/unload position illustrated in FIG. 1 whereupon the above process is repeated.

From the foregoing, it can be seen that a primary advantage of the present invention is that the entire hemming operation can be performed from part load and through the final hem operation by only changing the direction of rotation of the shaft a single time. This decreases the cycle time for the hemming machine over the previously known devices.

Having described my invention, however, many modifications thereto will become apparent to those skilled in the art to which it pertains without deviation from the spirit of the invention as defined by the scope of the appended claims.

We claim:

1. A hemming machine comprising:

a base, a nest, a nest carrier which supports and is slidably mounted relative to said nest, means for vertically slidably mounting said nest and said nest carrier to said base, at least one hemming die, means for laterally slidably mounting said hemming die between an extended position in which said die overlies a portion of said nest, and a retracted position in which said die is laterally spaced from the nest, means for selectively moving said at least one die between said extended and said retracted position, and means for selectively hydraulically vertically displacing said nest relative to said nest carrier wherein said hydraulic displacing means comprises at least one driven bladder sandwiched between said nest and said nest carrier, a piston, at least one drive bladder sandwiched between said piston and said nest, and means for fluidly connecting said at least one drive bladder to said at least one driven bladder.

2. The invention as defined in claim 1 wherein said hydraulic displacing means comprises means for vertically moving said nest and said nest carrier, said vertical moving means comprising at least one air pressurized bladder sandwiched between said base and said nest carrier.

3. The invention as defined in claim 2 wherein said displacing means further comprises a threaded shaft rotatably mounted to said base, said shaft engaging a threaded bore in said piston, said piston abutting against an upper surface of said nest carrier, and means for rotatably driving said shaft.

4. The invention as defined in claim 3 wherein said threaded shaft engaging a threaded bore may be a ball-screw system to improve efficiency.

5. The invention as defined in claim 4 and comprising a lock unit laterally slidably mounted to said base between a retracted position in which said lock unit is spaced laterally outwardly from said nest carrier, and an extended position in which said lock unit abuts against said nest carrier and prevents downward vertical movement of said nest carrier relative to said base at at least one predetermined vertical position of said nest carrier relative to said base.

6. The invention as defined in claim 5 wherein said lock unit abuts against said nest carrier and prevents downward vertical movement of said nest carrier relative to said base at at least two predetermined vertical positions of said nest carrier relative to said base.

7. The invention as defined in claim 6 wherein said lock unit presents a wedged surface of contact to gently engage under the nest mounting plate, and reduce by there the stroke to be performed by the driven bladders.

8. The invention as defined in claim 3 wherein said at least one drive bladder is sandwiched between an upper surface of said piston and said nest.

9. The invention as defined in claim 5 wherein said at least one die comprises at least one prehem die and at least one final hem die, said prehem and final hem dies being vertically spaced apart by a preset distance, and wherein said at least two predetermined distances are vertically spaced apart from each other by said preset distance.

10. The invention as defined in claim 3 wherein said means for rotatably driving said shaft comprises an electric motor, and preferably a servo drive motor able to accurately control the final prehem and hemming force applied.

11. The invention as defined in claim 1 wherein said at least one drive bladder comprises at least two drive bladders, and means for fluidly connecting said drive bladders together, and equalize internal pressure between each driven bladder.

12. The invention as defined in claim 1 wherein any of said drive bladders, driven bladders, and even air spring bladders can be replaced by a standard rod cylinder without disrupting or transgressing with the field and the matter of the present invention.

13. The invention as defined in claim 2 wherein any of said drive bladders, driven bladders, and even air spring bladders can be replaced by a standard rod cylinder without disrupting or transgressing with the field and the matter of the present invention.

* * * * *